US009153148B2

(12) United States Patent
Ricci et al.

(10) Patent No.: US 9,153,148 B2
(45) Date of Patent: Oct. 6, 2015

(54) SIGNAGE SYSTEM AND METHOD FOR DISPLAYING MERCHANDISE ON SHELVES

(75) Inventors: John Ricci, Kleinburg (CA); Frank Borges, Oakville (CA)

(73) Assignee: Dana Industries Inc., Etobicoke (CA)

( * ) Notice: Subject to any disclaimer, the term of this patent is extended or adjusted under 35 U.S.C. 154(b) by 30 days.

(21) Appl. No.: 13/041,143

(22) Filed: Mar. 4, 2011

(65) Prior Publication Data

US 2011/0239501 A1 Oct. 6, 2011

Related U.S. Application Data

(60) Provisional application No. 61/310,944, filed on Mar. 5, 2010.

(51) Int. Cl.

| | |
|---|---|
| ***G09F 3/10*** | (2006.01) |
| ***G09F 3/20*** | (2006.01) |
| ***G09F 23/04*** | (2006.01) |
| ***G09F 23/06*** | (2006.01) |
| *G09F 3/18* | (2006.01) |
| *G09F 3/02* | (2006.01) |
| *A47F 11/06* | (2006.01) |

(52) U.S. Cl.

CPC ..... *G09F 3/204* (2013.01); *G09F 23/04* (2013.01); *G09F 23/06* (2013.01); *A47F 11/06* (2013.01); *G09F 3/02* (2013.01); *G09F 3/10* (2013.01); *G09F 3/18* (2013.01); *G09F 3/20* (2013.01); *Y10T 29/49826* (2015.01)

(58) Field of Classification Search

CPC ..... G09F 3/20; G09F 3/18; G09F 3/10; G09F 3/02

USPC ..... 40/638, 649, 661.08, 642.02, 541, 572, 40/570; 248/223.41; 206/449

See application file for complete search history.

(56) References Cited

U.S. PATENT DOCUMENTS

| | | | | |
|---|---|---|---|---|
| D79,119 | S | | 7/1929 | Rau |
| 2,130,945 | A | | 9/1938 | Brownell |
| 2,297,888 | A | * | 10/1942 | Heileman ..... 40/649 |
| 2,720,044 | A | | 10/1955 | Montalto |
| 2,838,860 | A | | 6/1958 | Finnerty et al. |
| 2,923,078 | A | | 2/1960 | Slavsky |
| 3,077,686 | A | | 2/1963 | Montalto |
| 3,423,860 | A | | 1/1969 | Berry, Jr. et al. |
| 3,774,328 | A | | 11/1973 | Tanney |
| 3,903,629 | A | | 9/1975 | Gruna |
| 3,977,109 | A | | 8/1976 | Berry et al. |
| 4,152,851 | A | | 5/1979 | Goldstein |
| 4,306,366 | A | | 12/1981 | Taub |
| 4,317,303 | A | * | 3/1982 | Sernovitz ..... 40/564 |
| 4,338,739 | A | | 7/1982 | Greenberger |
| 4,541,598 | A | | 9/1985 | Villanueva et al. |
| 4,645,701 | A | | 2/1987 | Zarrow |
| 4,798,014 | A | | 1/1989 | Stoerzinger et al. |
| 4,829,689 | A | | 5/1989 | Alshooler |
| 4,919,377 | A | * | 4/1990 | Alexander et al. ..... 248/223.41 |
| 5,344,250 | A | | 9/1994 | Kringel |

(Continued)

*Primary Examiner* — Syed A Islam

(74) *Attorney, Agent, or Firm* — Santosh K. Chari; Blake, Cassels & Graydon LLP

(57) ABSTRACT

A signage system comprises a plurality of signs adapted to be mounted on a shelf or other such merchandise display device. The signs include a mounting portion, for attaching to the shelf, and a sign portion. The sign portions are provided with a shape corresponding to common shapes of traffic or road signs. The system of the invention may therefore be used to attract or direct customers to certain specific products.

7 Claims, 11 Drawing Sheets

(56) References Cited

U.S. PATENT DOCUMENTS

| | | | | |
|---|---|---|---|---|
| 5,695,061 | A | 12/1997 | Stompe | |
| D399,260 | S | 10/1998 | Thimote | |
| 5,832,644 | A | 11/1998 | Mason | |
| 5,848,698 | A * | 12/1998 | Stompe | 206/449 |
| 5,967,343 | A | 10/1999 | Dufresne | |
| 6,240,665 | B1 * | 6/2001 | Brown et al. | 40/570 |
| 6,354,546 | B1 | 3/2002 | Mueller | |
| 6,581,312 | B2 | 6/2003 | Padiak | |
| 6,649,238 | B2 * | 11/2003 | Chess et al. | 428/40.1 |
| 6,701,653 | B2 | 3/2004 | Chess et al. | |
| D496,397 | S | 9/2004 | Melnyk | |
| 6,817,127 | B2 | 11/2004 | Gottlieb et al. | |
| D501,668 | S | 2/2005 | Kayoum | |
| 6,981,343 | B2 | 1/2006 | Rawlings | |
| 7,009,524 | B2 | 3/2006 | Capurso | |
| 7,401,430 | B2 | 7/2008 | Lindquist | |
| 7,587,849 | B2 | 9/2009 | Robbins et al. | |
| D608,395 | S | 1/2010 | Engelby et al. | |
| D627,828 | S | 11/2010 | Ricci et al. | |
| D631,917 | S | 2/2011 | Ricci et al. | |
| 2004/0211820 | A1 | 10/2004 | Berger | |
| 2009/0211126 | A1 * | 8/2009 | Oh | 40/124.03 |

* cited by examiner

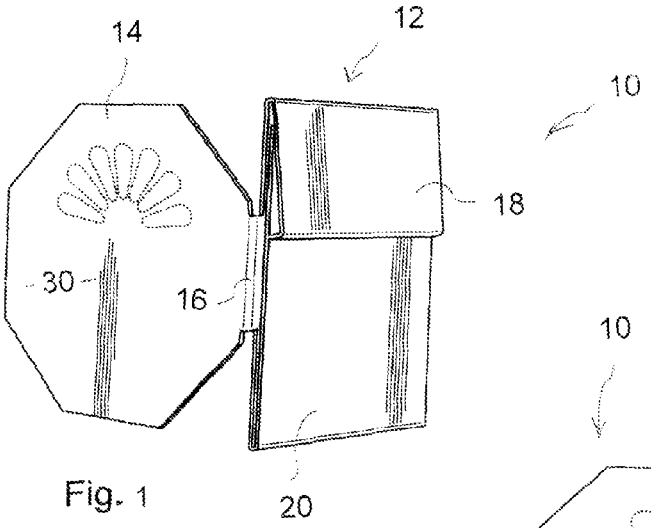
Fig. 1
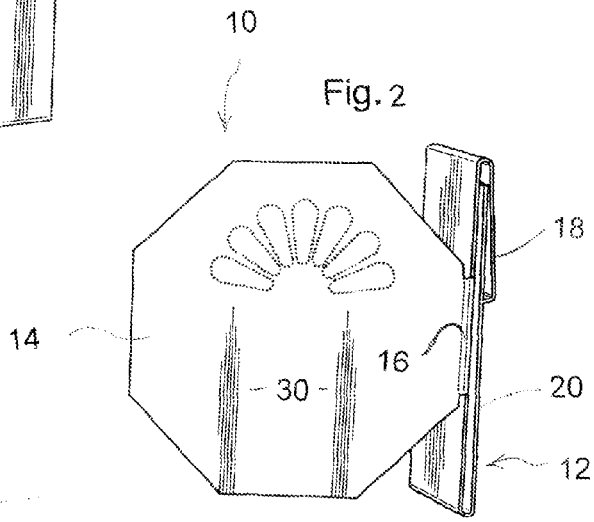
Fig. 2
Fig. 3
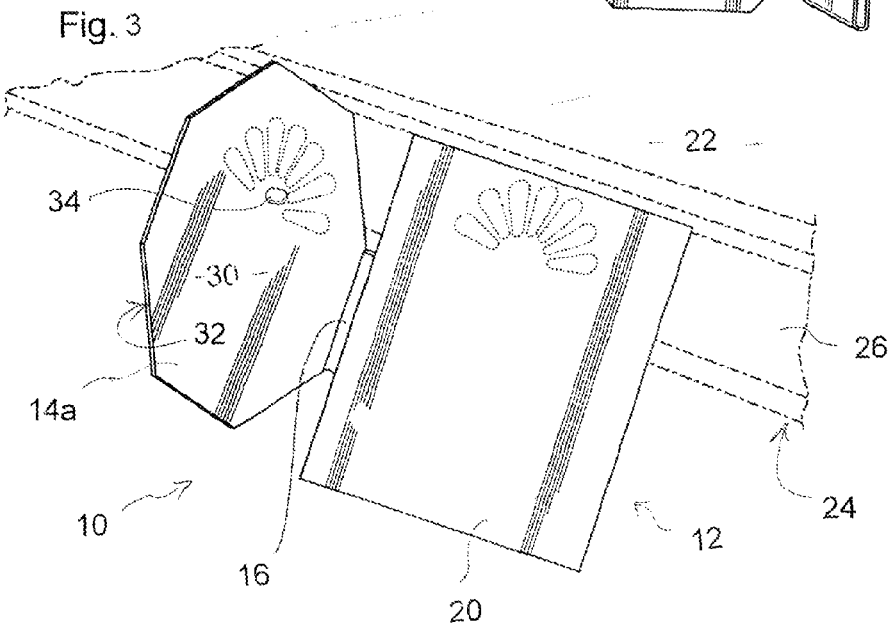

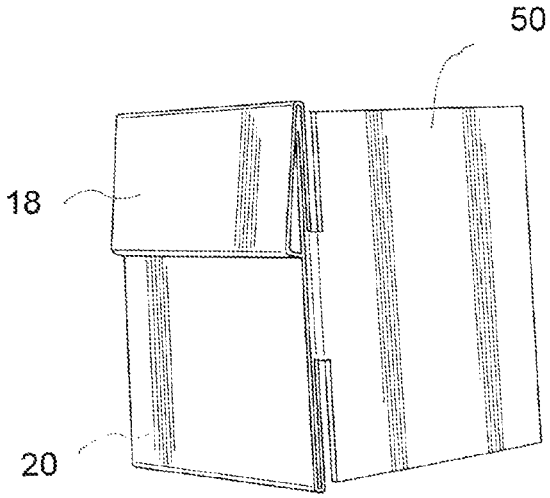
Fig. 8
Fig. 9
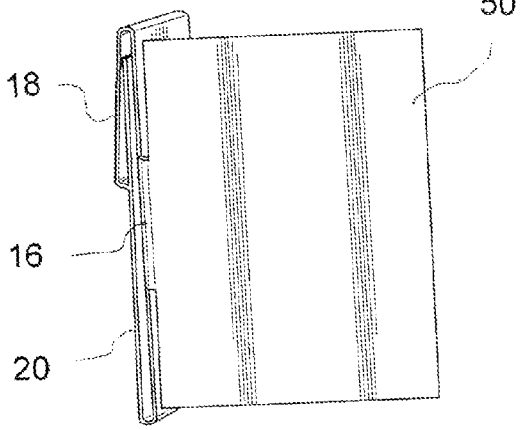
Fig. 10
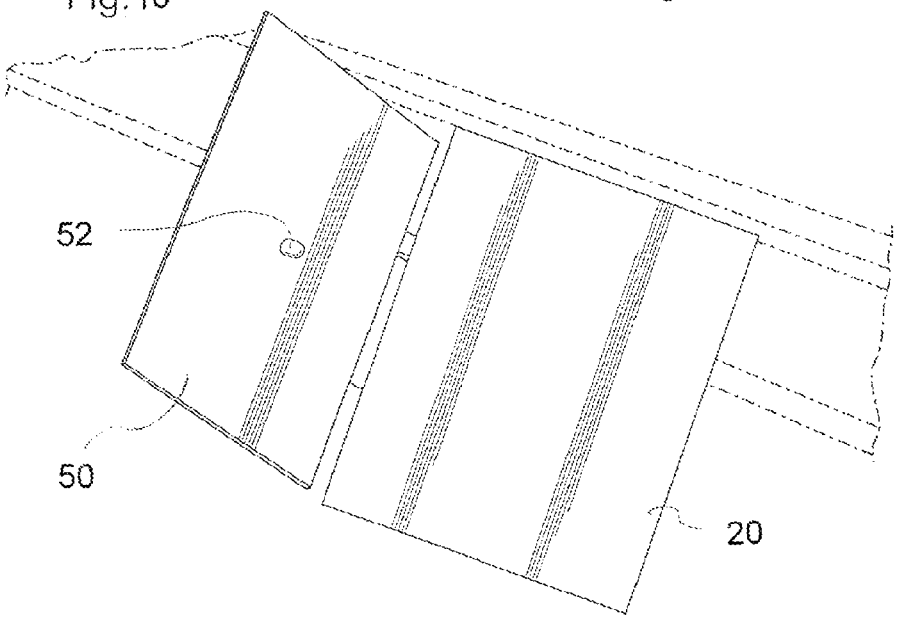

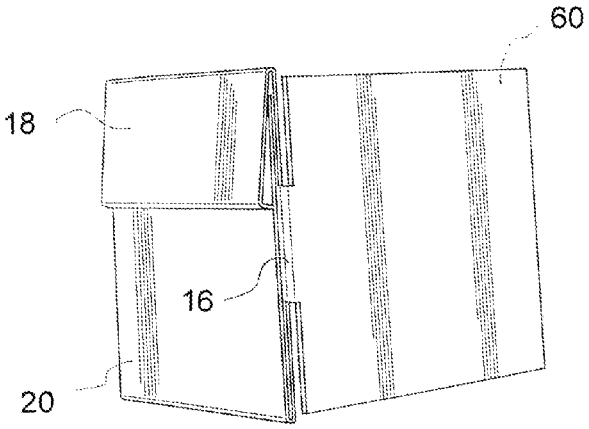
Fig.15
Fig.16
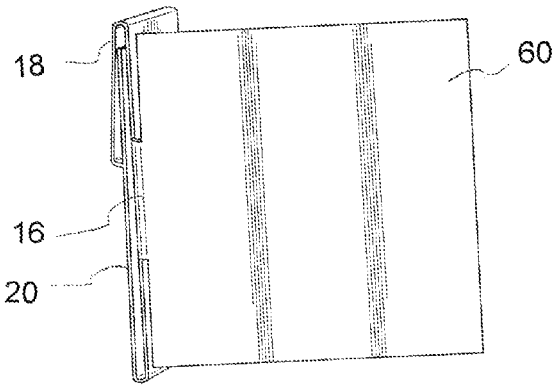
Fig. 17
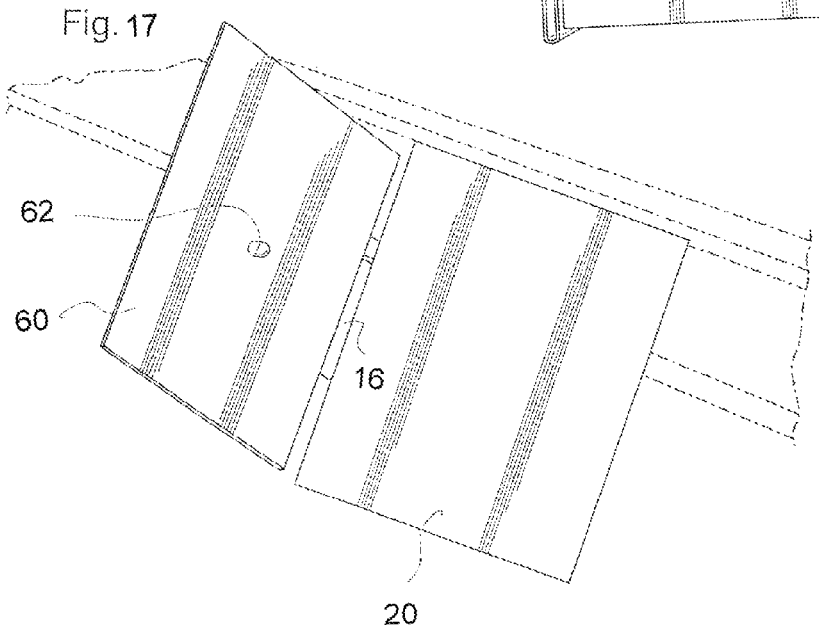

Fig.18
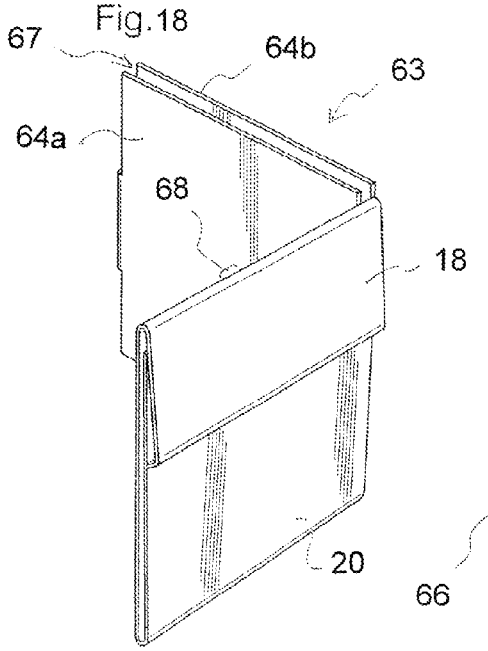
Fig.19
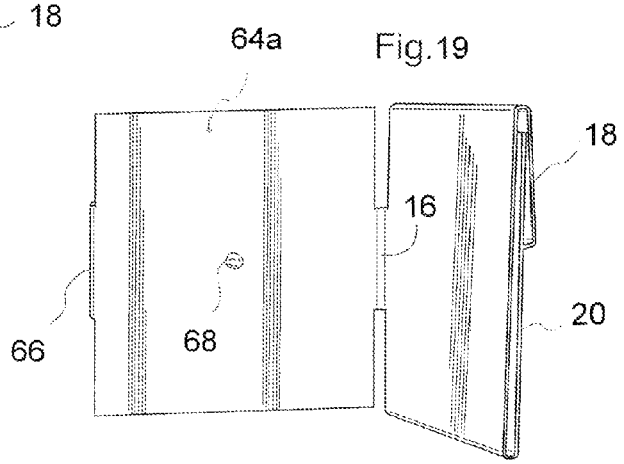
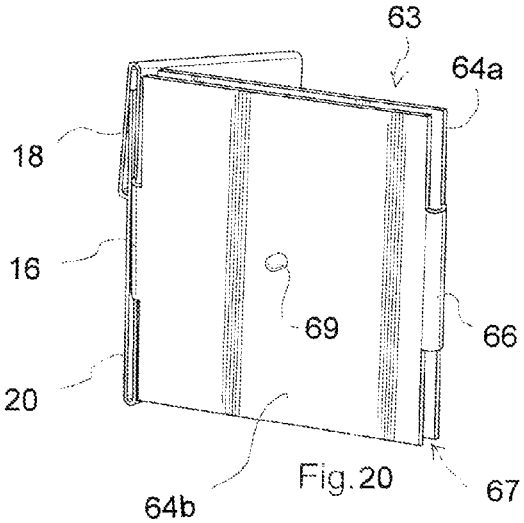
Fig.20
Fig. 21
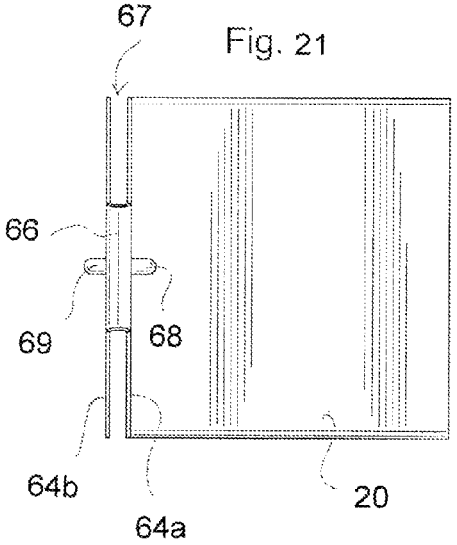

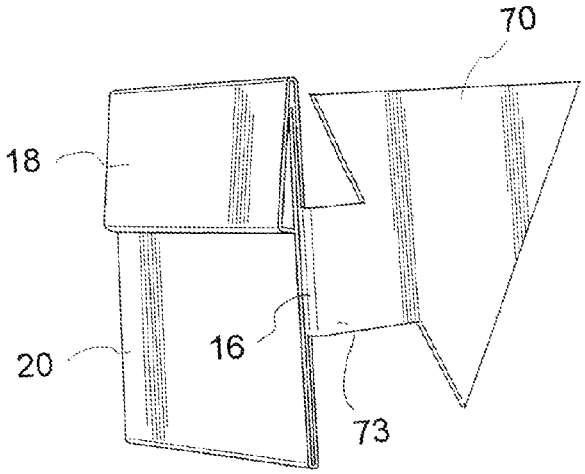
Fig.22
Fig.23
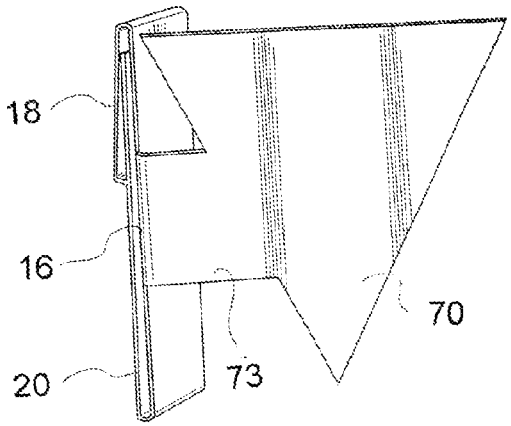
Fig.24
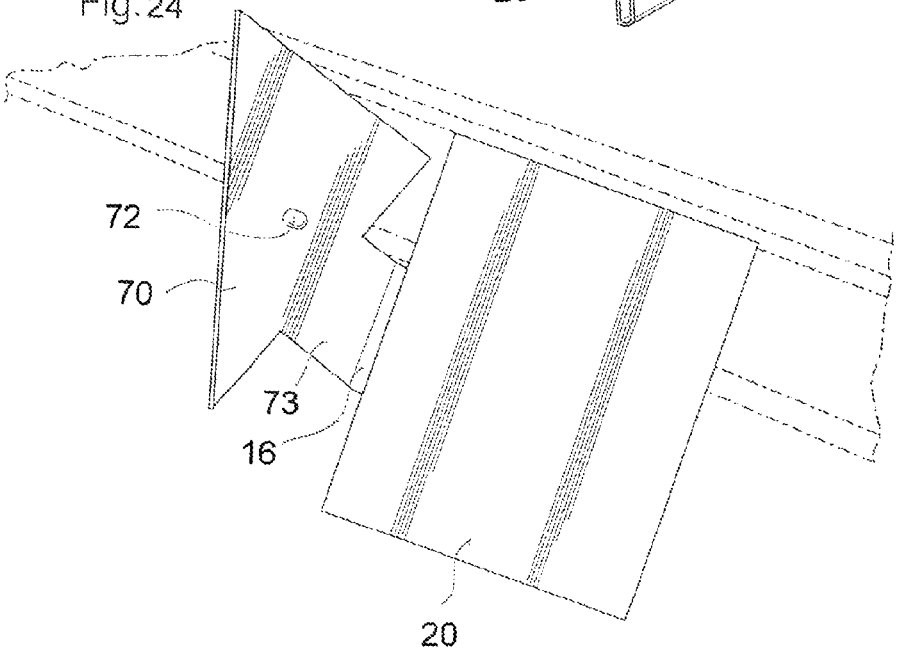

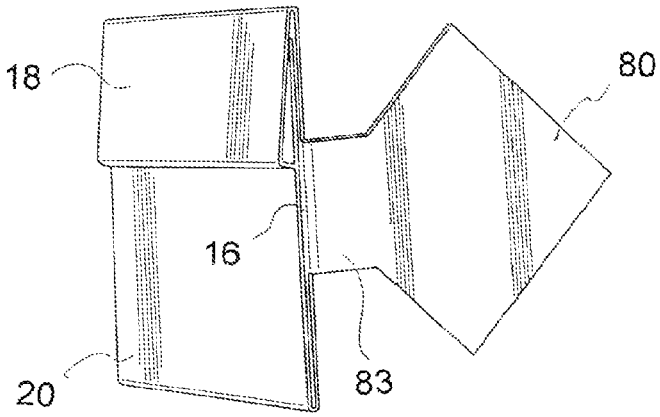
Fig. 29
Fig. 30
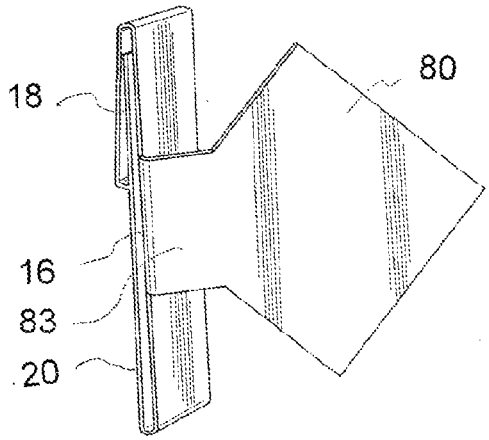
Fig. 31
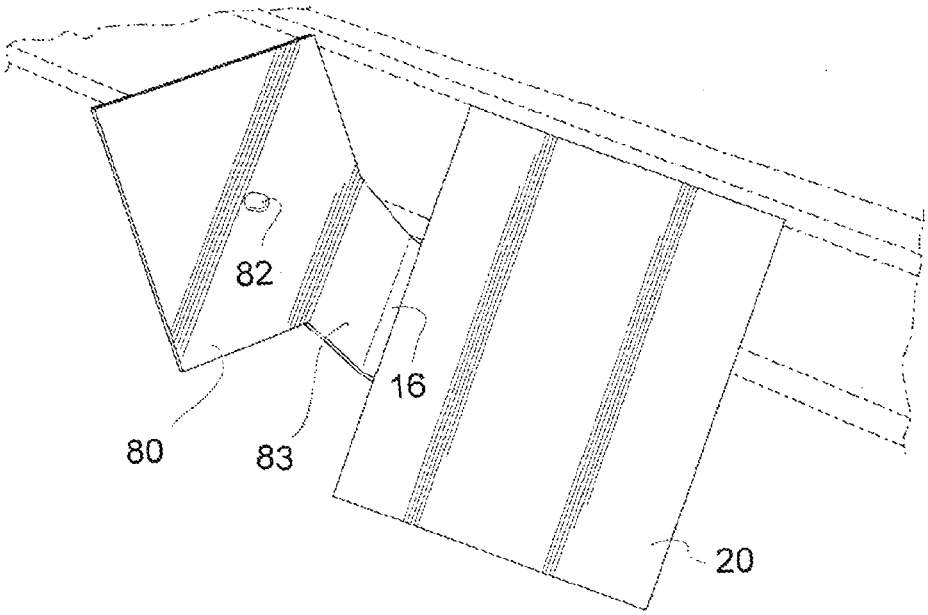

SIGNAGE SYSTEM AND METHOD FOR DISPLAYING MERCHANDISE ON SHELVES

CROSS REFERENCE TO RELATED APPLICATIONS

The present application claims priority from U.S. Application No. 61/310,944, filed Mar. 5, 2010, the entire contents of which are incorporated herein by reference.

FIELD OF THE INVENTION

The present invention relates to signage systems. More particularly, the invention relates to signage systems that are designed for use on shelving and the like and are preferably designed using traffic sign insignia. In another aspect, the invention relates to shelf mounted signs that preferably incorporate lighting means.

BACKGROUND OF THE INVENTION

In most commercial establishments where products are sold, the merchandise for sale is often placed on shelves, mounted on a wall or other structure, or otherwise displayed for potential customers. In addition to the products themselves, vendors often use signage to highlight their merchandise to customers and/or to provide such customers with details regarding products. It is often the case that the shelve or other display devices contain numerous products and, therefore, the signage used by the vendors may be not sufficiently highlight a particular item.

Signs commonly referred to as "shelf talkers" are known to be used by vendors to provide enhanced advertisement to certain products. This type of signage comprises a mounting or anchor portion, for fastening to a shelf, and a sign portion wherein the information being conveyed to the customer is displayed. In some cases, the sign portion depends upwardly or downwardly so as to allow customers to read the information when standing in front of the product. In other cases, the sign portion may protrude away from the shelf, sometimes orthogonal thereto, thereby serving to attract an approaching customer before the customer reaches the location of the product. As will be understood, the latter type of "shelf talkers" may be used to draw the attention of customers to a specific product or products.

Traffic, or road signs are ubiquitous in virtually every country. Such signs utilize specific, well known shapes for conveying information to drivers of vehicles. Examples of such shapes include, octagons (to signify "stop"), inverted triangles (to signify "yield"), diamonds (to signify "warning"). Other shapes are also known in the art. In addition, square and rectangle shapes are used to display directional or other such information. It is often only necessary for traffic signs to simply have one of the known shapes in order to provide adequate instructions to drivers, even in the absence of written words. For example, a red octagon would instruct a driver to stop without having the word printed on the sign. In some cases, icons or other symbols may be used with the signs to further clarify the intended message.

The present inventors have developed a unique system of signage for use by vendors that utilizes the well recognized significance of traffic signs for the purpose of directing customers to certain merchandise and/or to highlight particular information concerning such merchandise. The inventors have also developed a system of signage for mounting on shelving, wherein the signage includes a lighting means for further attracting attention to a particular area on display.

SUMMARY OF THE INVENTION

In one aspect, the present invention provides a signage system, for displaying merchandise, the system comprising a plurality of signs associated with the merchandise, wherein each of the signs comprises a mounting portion, for attachment to a support, and a sign portion, and wherein: the sign portions comprise shapes of traffic signs; and, the sign portions are angularly offset from the mounting portions.

In another aspect, the present invention provides a signage kit for displaying merchandise, the kit comprising a plurality of signs, wherein each of the signs comprise a mounting portion for attachment to a support, and a sign portion, and wherein: the sign portions comprise shapes of traffic signs; and, the sign portions are angularly offset from the mounting portions.

In another aspect, the invention provides a method of displaying merchandise on a support, the method comprising:

providing a plurality of signs, wherein each of the signs comprise a mounting portion for attachment to a support and a sign portion and wherein the sign portions comprise shapes of traffic signs and wherein the sign portions are angularly offset from the mounting portions;

attaching the mounting portions of the signs to one or more supports; and, arranging the signs so as to convey visual information on the merchandise to customers by means of the shapes of traffic signs.

The sign portions of the invention comprise octagons, triangles, diamonds, squares, or rectangles. The sign portions are preferably angularly offset from the mounting portions.

The sign portions may comprise one or two panels and may include one or more light emitting means.

BRIEF DESCRIPTION OF THE DRAWINGS

The features of the invention will become more apparent in the following detailed description in which reference is made to the appended drawings, wherein:

FIG. 1 is a rear perspective view of a shelf sign according to one aspect of the invention.

FIG. 2 is a left perspective view of the sign of FIG. 1.

FIG. 3 is a left perspective view of a variation of the sign of FIG. 1.

FIGS. 8 to 10 illustrate another aspect of the invention, wherein the sign portion comprises a generally rectangular shaped panel.

FIGS. 15 to 17 illustrate another aspect of the invention, wherein the sign portion comprises a generally square shaped panel.

FIGS. 18 to 21 illustrate another aspect of the invention, wherein the sign portion comprises a pair of opposed generally square shaped panels.

FIGS. 22 to 24 illustrate another aspect of the invention, wherein the sign portion comprises a generally inverted triangular shaped panel.

FIGS. 29 to 31 illustrate another aspect of the invention, wherein the sign portion comprises a generally diamond shaped panel.

In the figures, like reference numerals are used to identify like elements. For clarity, where one or more elements shown in a given figure are slightly different from that of another figure, the same reference numeral is used but with a letter suffix to distinguish the two.

DETAILED DESCRIPTION OF THE INVENTION

Figure 4:
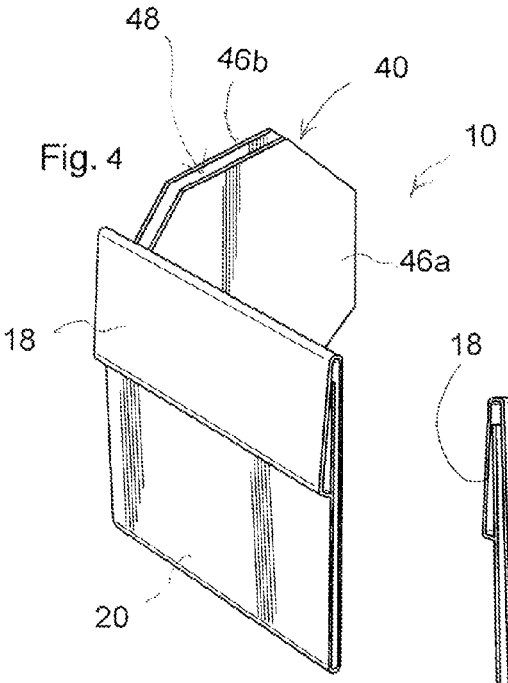
FIG. 4 is rear perspective view of a shelf sign according to another aspect of the invention.
Figure 6:
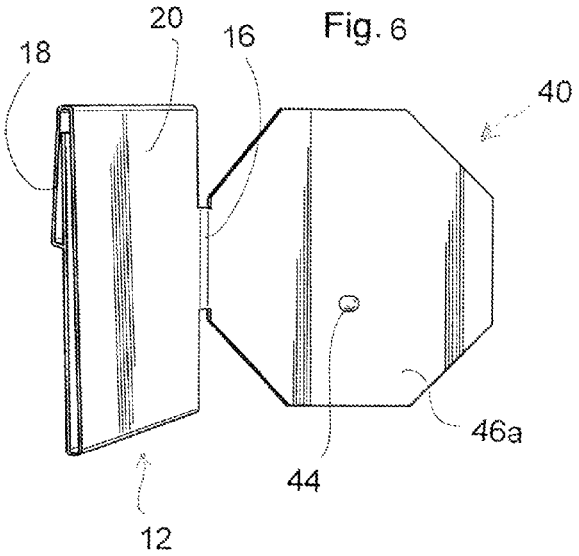
FIG. 6 is front perspective view of the sign of FIG. 4.
Figure 5:
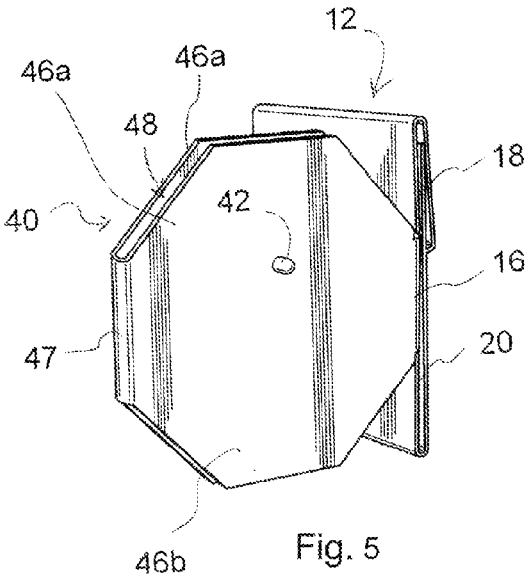
FIG. 5 is a left perspective view of the sign of FIG. 4.

As used herein, the term "shelf talker" will be understood to have the meaning as known in the art. Specifically, this term will be understood to mean a sign that is designed to show specific information concerning a particular product or products in a commercial setting. Such information may, for example, comprise a special price or other information or details regarding a feature of the products in question. The signs of the invention generally hang from a shelf displaying the products and serve to draw attention to the product with which they are associated. For the purpose of the present description, the terms "shelf talker" and "sign" or "signage" will be understood as having the same meaning.

As indicated above, the present inventors have combined the concept of road or traffic signs with signage for shelving as used by vendors. In particular, the inventors have developed a novel shelf talker system utilizing shapes of traffic signs for allowing vendors to direct customers to specific products.

As known to persons skilled in the art, shelf talkers may either lie in the plane of the shelf of may project away from the shelf at a given angle, typically 90°. The present invention contemplates signs, or shelf talkers, of any known configuration. However, as will be appreciated by persons skilled in the art upon reviewing the following description, the effectiveness of the present invention is particularly realized in signage that projects away from the shelf.

FIGS. 1 and 2 illustrate an aspect of the invention. As shown, the sign 10 of the invention includes a mounting portion 12 and a sign portion 14. The sign portion 14 is connected to the shelf portion 12 by a connecting member or hinge 16. In the preferred embodiment, the sign portion 14 is angularly offset from the mounting portion 12. Such angular offset may be achieved by forming the angle into the hinge 16. In one aspect, the angular offset of the hinge 16 is fixed, thereby establishing a pre-determined angle between the mounting portion 12 and sign portion 14. As shown in FIGS. 1 and 2, such angle may be approximately 90° or any other angle that serves the purpose of attracting the attention of customers. All parts of the sign 10 are preferably, though not exclusively, made of a plastic material.

The mounting portion 12 generally includes a hook 18 or other such mounting means or bracket, as known in the art, for attaching the sign to a shelf or other such display device. The mounting portion 12 also preferably includes a support member 20, which serves to brace the sign against the shelf when the sign is mounted. The hinge 16 connects the sign portion 14 to the support member 20 of the mounting portion 12. As shown in the accompanying figures, the support member 20 is generally formed in two layers in order to provide sufficient rigidity. However, for the purposes of the present discussion, the support member will be referred to in the singular. Such reference in the singular is not intended to limit the invention in any way.

It will be understood that the support member 20 may also comprise a "shelf talker" as known in the art, by itself, in the absence of any sign portion 14. Thus, the exposed face of the support member 20 (i.e. the face viewed by a customer) may include text, insignia or other such markings as needed by the vendor.

FIG. 3 illustrates an aspect of the invention wherein the sign 10 is secured to a shelf. As shown, the shelf 22 includes an edge 24 that faces an aisle or similar passageway where customers pass. The products or merchandise being displayed is supported on the shelf 22. In FIG. 3, the sign 10 is shown attached to the edge 24 of the shelf by fastening the hook 18 thereto. To facilitate the attachment of the sign 10, the edge 24 of the shelf 22 is preferably provided with a mounting track 26 as known in the art, which is adapted to receive and retain the hook 18. Mounting tracks, such as that shown at 26, are known in the art. Although the present description assumes that a track is used, it will be understood that any means of securing the sign to a shelf may be used. For example, in some cases, the shelf may include a formed structure at its edge, designed to cooperate with a portion of the sign. Alternatively, although not preferred, the sign may simply be affixed to the shelf with an adhesive or similar device (such as hook and loop fasteners, i.e. Velcro®).

It should be noted that the embodiment of the invention shown in FIG. 3 illustrates a different orientation of the sign portion 14*a* as compared to FIGS. 1 and 2. Specifically, in FIGS. 1 and 2, the sign portion 14 extends from the left side of the mounting portion 12 whereas in FIG. 3, the sign portion 14*a* extends from the right side. It will be understood that either orientation is within the scope of the present invention.

The embodiment of the invention illustrated in FIGS. 1 to 3 includes a sign portion 14, 14*a* that is generally octagonal shape. As will be understood, this shape is similar to that of a "stop" sign as used on roads for directing traffic. Thus, such a shape of the sign portion 14, 14*a* may be used to cause customers, or shoppers, to stop at a particular location and review a particular product or products. In this regard, the sign portion 14, 14*a* is provided with opposing faces 30 and 32. It will be understood that the faces 30 and 32 may be provided with the same or different insignia, markings etc.

In the embodiment shown in FIG. 3, the sign portion 14*a* further includes an optional light emitting means, or bulb 34 that serves as another means of attracting customers to a desired location. It will be understood that the light emitted by the bulb 34 may be constantly illuminated or may include a flashing or strobing means. It will also be understood that the light may be of any color and that different colors, with or without the combination of the strobing feature, may be used to designate different meanings or messages. Such meanings or messages may be displayed for the viewer either on the sign portions 14, 14*a*, or on the face of the support member 20 or elsewhere on the shelf or in the store. Although the term "bulb" is used herein, it will be understood that the light emitting means may comprise any form of device that generates light. For example, the bulb 34 may comprise a light emitting diode (LED) or other such device. Preferably, since the sign materials are plastic, the light emitting means 34 is one that does not generate large amounts of heat so as to prevent damage to the plastic components.

Figure 7:
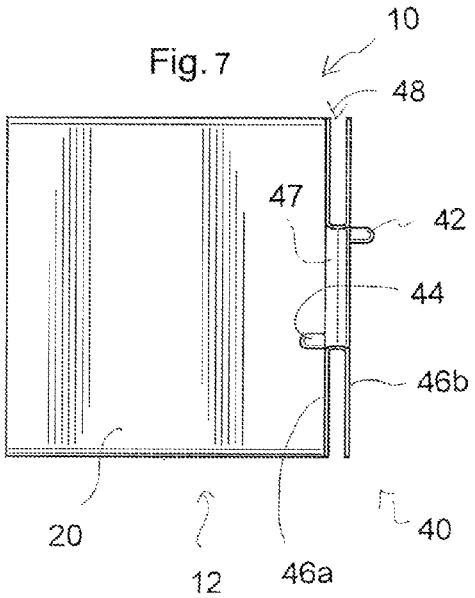
FIG. 7 is a front view of the sign of FIG. 4.
Figure 11:
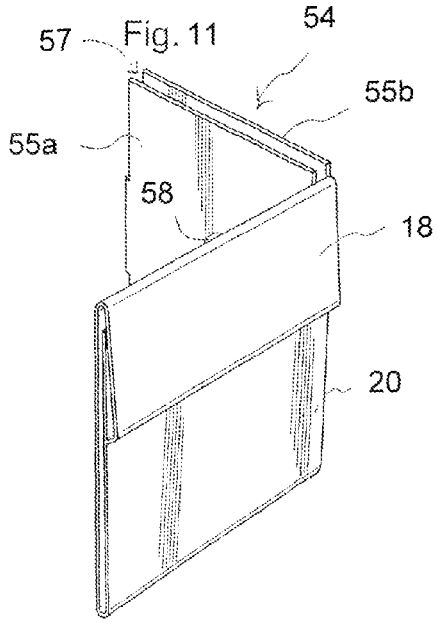
FIGS. 11 to 14 illustrate another aspect of the invention, wherein the sign portion comprises a pair of opposed generally rectangular shaped panels.
Figure 12:
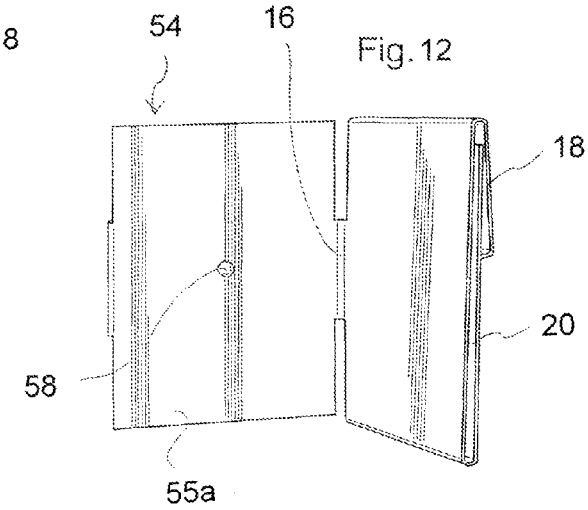

FIGS. 4 to 7 illustrate another embodiment of sign 10 of FIGS. 1 to 3. As shown, the sign 10 illustrated in FIGS. 4 to 7, includes the same features as those described above. However, the sign portion 40 is provided in the form of a two layer structure, having two opposed layers or panels 46*a* and 46*b*, joined by a connector or connecting element 47. The connector 47 comprises a contiguous portion of the panels 46*a* and 46*b* that is folded to provide the structure shown at 40. Such a structure is preferable in situations where a light source, such as bulbs 42 and 44 are provided, respectively, on the exposed faces of the panels 46*a* and 46*b* of the sign portion 40. In such cases, the two layer structure allows for the battery and circuitry etc. for powering and/or controlling the bulbs 42 and 44 to be contained in a space 48 provided between the two layers forming the sign portion 40. In FIG. 7, an embodiment of the invention is shown wherein the bulbs 42 and 44 are offset vertically (when the sign is mounted) from each other. It will be understood that the bulbs 42 and 44 may equally be placed in direct opposition to each other, as illustrated in other embodiments describer herein. In another embodiment, any number of bulbs may be provided on one or both sides of the sign portion 40. It will be understood that the provision of bulbs 42 and 44 is a preferred embodiment of the invention and is not to be considered as limiting the invention in any way.

Figure 13:
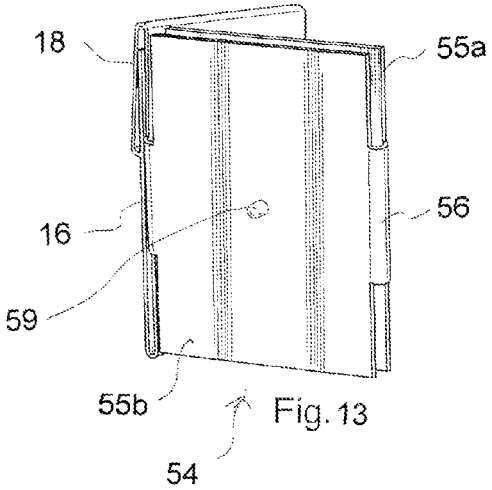
Figure 14:
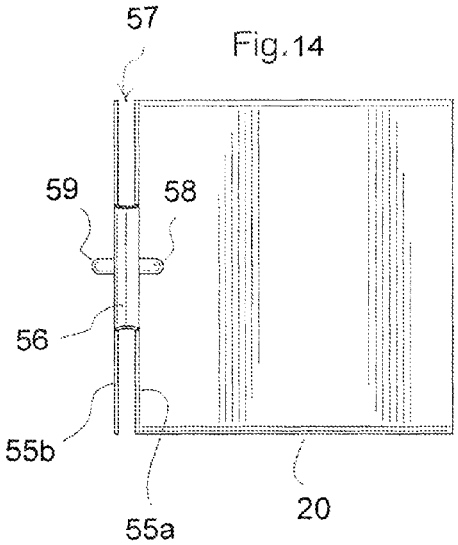
Figure 25:
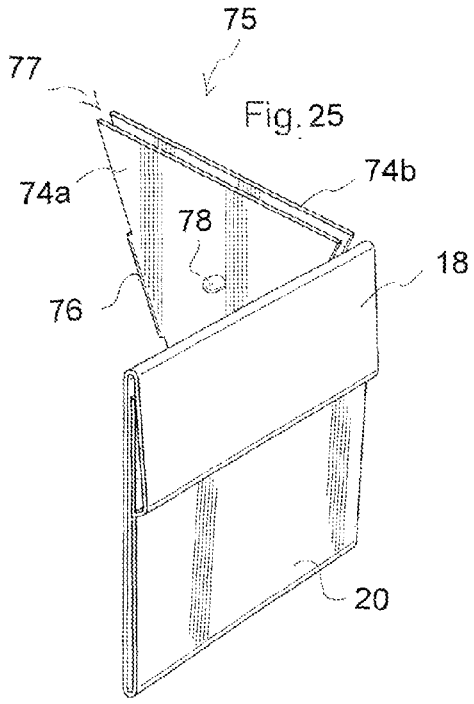
FIGS. 25 to 28 illustrate another aspect of the invention, wherein the sign portion comprises a pair of opposed generally inverted triangular shaped panels.
Figure 26:
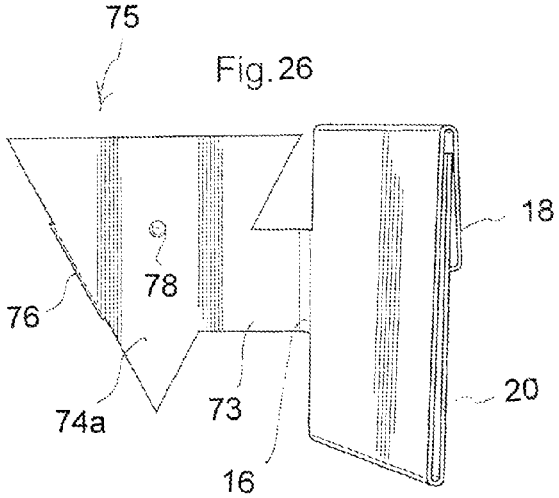
Figure 27:
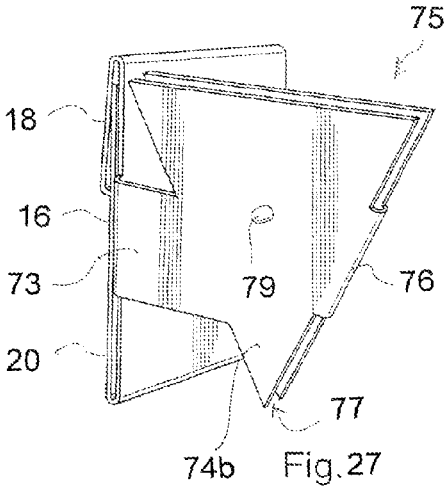
Figure 28:
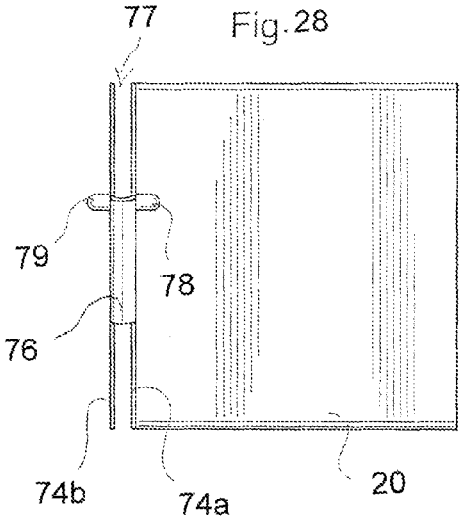
Figure 32:
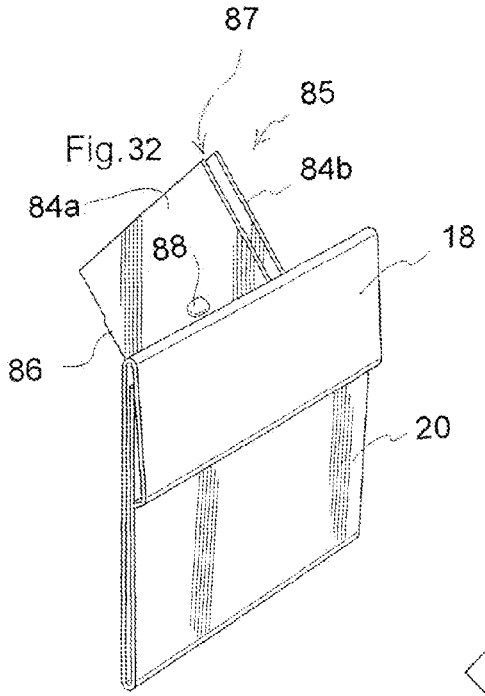
FIGS. 32 to 35 illustrate another aspect of the invention, wherein the sign portion comprises a pair of opposed generally diamond shaped panels.
Figure 33:
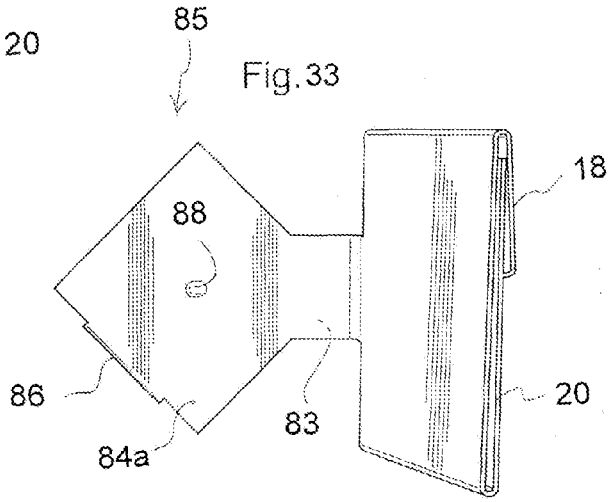
Figure 34:
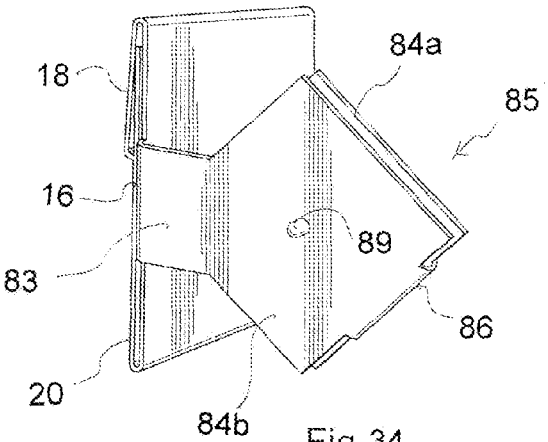
Figure 35:
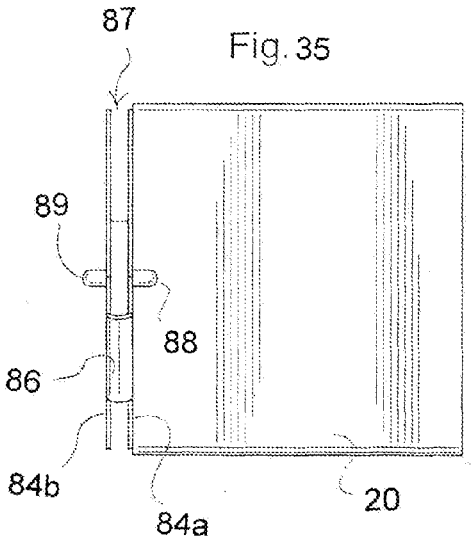

FIGS. 8 to 10 illustrate an embodiment of the invention wherein the sign portion 50 comprises a single panel of a generally rectangular shape. FIG. 13 illustrates the sign portion 50 with an optional bulb 52 on at least one face thereof. Such bulbs were described previously.

FIGS. 11 to 14 illustrate an embodiment of the invention having a generally rectangular shaped sign portion 54, as described above with reference to FIGS. 8 to 10, but wherein such portion is formed by two opposed panels 55*a* and 55*b*. The panels are joined together by a connector or connecting element 56, as described previously, and are preferably separated by a space 57. As shown, one or both of the panels 55*a* and 55*b* are preferably provided with one or more bulbs 58 and 59.

FIGS. 15 to 17 illustrate an embodiment of the invention wherein the sign portion 60 comprises a single panel of a generally square shape. FIG. 17 illustrates the sign portion 60 with an optional bulb 62 on at least one face thereof.

FIGS. 18 to 20 illustrate an embodiment of the invention having a generally rectangular shaped sign portion 63, as described above with reference to FIGS. 15 to 17, but wherein such portion is formed by two opposed panels 64*a* and 64*b*. The panels are joined together by a connector or connecting element 66, as described previously, and are preferably separated by a space 67. As shown, one or both of the panels 64*a* and 64*b* are preferably provided with one or more bulbs 68 and 69.

FIGS. 22 to 24 illustrate an embodiment of the invention wherein the sign portion 70 comprises a single panel of a generally inverted triangular shape. FIG. 24 illustrates the sign portion 70 with an optional bulb 72 on at least one face thereof. As will be noted, due to the triangular shape of the sign portion 70, a connecting arm 73 is provided in order to extend from the hinge 16 (connected to the support member 20) to the sign portion 70.

FIGS. 25 to 28 illustrate an embodiment of the invention having a generally inverted triangular shaped sign portion 75, as described above with reference to FIGS. 22 to 24, but wherein such portion is formed by two opposed panels 74*a* and 74*b*. The panels are joined together by a connector or connecting element 76, as described previously, and are preferably separated by a space 77. As shown, one or both of the panels 74*a* and 74*b* are preferably provided with one or more bulbs 78 and 79.

FIGS. 29 to 31 illustrate an embodiment of the invention wherein the sign portion 80 comprises a single panel of a generally diamond shape. FIG. 31 illustrates the sign portion 80 with an optional bulb 82 on at least one face thereof. As will be noted, due to the diamond shape of the sign portion 80, a connecting arm 83 is provided in order to extend from the hinge 16 (connected to the support member 20) to the sign portion 80.

FIGS. 32 to 35 illustrate an embodiment of the invention having a generally diamond shaped sign portion 85, as described above with reference to FIGS. 29 to 31, but wherein such portion is formed by two opposed panels 84*a* and 84*b*. The panels are joined together by a connector or connecting element 86, as described previously, and are preferably separated by a space 87. As shown, one or both of the panels 84*a* and 84*b* are preferably provided with one or more bulbs 88 and 89.

Figure 37:
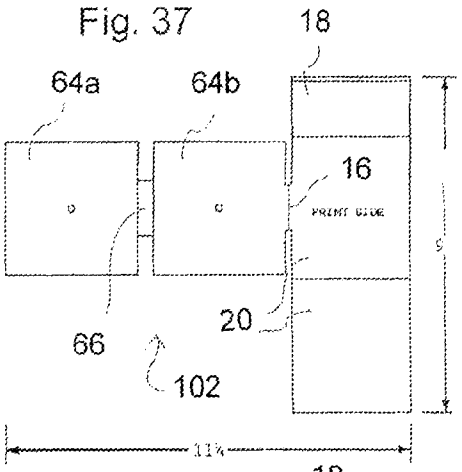
FIG. 37 illustrates a blank for forming the signs of FIGS. 18 to 21.
Figure 36:
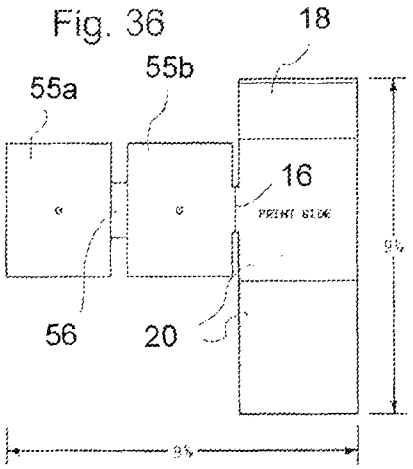
FIG. 36 illustrates a blank for forming the signs of FIGS. 11 to 14.
Figure 38:
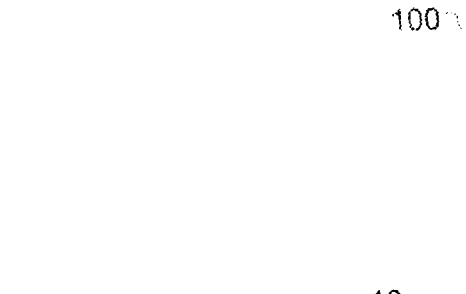
FIG. 38 illustrates a blank for forming the signs similar to those of FIGS. 4 to 7.
Figure 39:
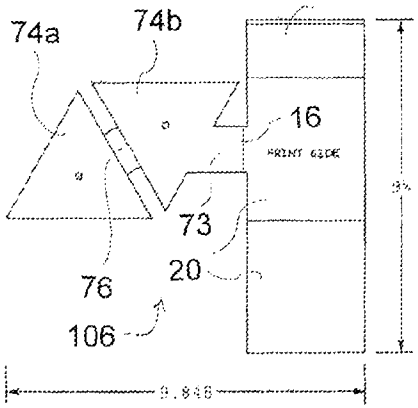
FIG. 39 illustrates a blank for forming the signs of FIGS. 25 to 28.
Figure 40:
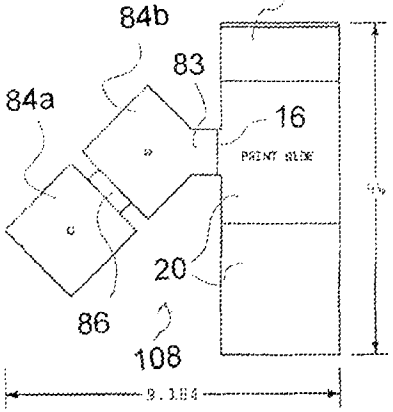
FIG. 40 illustrates a blank for forming the signs of FIGS. 32 to 35.

FIGS. 36 to 40 illustrate blanks that can be used for forming the various two panel signs described above. As shown, FIG. 36 illustrates a blank 100 for forming the rectangular sign shown in FIGS. 11 to 14. FIG. 37 illustrates a blank 102 for forming the square sign shown in FIGS. 18 to 21. FIG. 39 illustrates a blank 106 for forming the inverted triangular shaped sign shown in FIGS. 25 to 28. Finally, FIG. 40 illustrates a blank 108 for forming the diamond shaped sign shown in FIGS. 32 to 35.

FIG. 38 illustrates a blank 104 for forming octagonal shaped signs that are similar to those shown in FIGS. 3 to 7. However, as noted, the blank 104 results in a sign wherein the sign portion 40 is in an opposite side of the sign as compared to that shown in FIGS. 3 to 7. As will be understood, the orientations of the sign portions of any of the embodiments described herein is purely for the purposes of illustration and various other orientations will be apparent to persons of skill in the art having regard to the present description.

As mentioned above, the present invention comprises a system and method of signage wherein a collection of signs of one or more traffic sign shapes (such as those described above) is used to advertise, promote, or provide information regarding a specific product or products. The products would be generally displayed on a shelf or similar display apparatus. It will be understood although the invention is primarily suited for drawing attention to articles or products placed on shelving, it may be adapted for use with other display apparatuses. For example, the system of the invention may be adapted for use with rotating display devices instead of shelving.

The system and method of the invention utilize signs that have a sign portion that is offset from the plan of the shelf so as to protrude into the aisle through which customers pass. The purpose of such offset is to attract the attention of customers who are not in the vicinity of the products in question. For example, the signs of the invention may be used to attract the attention of an approaching customer and to convey information to such customer regarding the products. In this regard, the sign portions of the present invention are generally offset orthogonally to the shelf to which they are mounted. It will be understood that such orthogonal orientation is ideally suited for displaying products on shelves as the viewing angle of the sign would be equal from both directions of the aisle. It will, however, be understood that any other angle of offset may be used.

In general, the present invention uses commonly known road or traffic sign shapes in order to inform, advertise or draw the attention of consumers in a store. The signs are positioned so as to protrude into an aisle where such customers travel. Thus, the invention may be used to highlight specific products in a hierarchical manner. For example, some products may be identified with a diamond shaped sign to signify a "warning" that the product may change in pricing or that the supply of a product may be low.

In another aspect, the system of the invention may incorporate a combination of signs all directed to a specific product. For example, at the end of an aisle, a "yield" or inverted triangle shaped sign may be used to direct a customer to a product contained on one of the shelves in the given aisle. A "stop" or octagonal shaped sign may then be used to cause the customer to stop at the location of the product.

It will be understood that various other combinations of signs may be used for different reasons. As indicated above, the system of the invention utilizes the customers' prior recognition of common road signs but in a store setting.

The invention also includes kits containing a plurality of signs, wherein the signs include a variety of sign portion shapes.

Although the invention has been described with reference to certain specific embodiments, various modifications thereof will be apparent to those skilled in the art without departing from the purpose and scope of the invention as outlined in the claims appended hereto. Any examples provided herein are included solely for the purpose of illustrating the invention and are not intended to limit the invention in any way. Any drawings provided herein are solely for the purpose of illustrating various aspects of the invention and are not intended to be drawn to scale or to limit the invention in any way. The disclosures of all prior art recited herein are incorporated herein by reference in their entirety.

We claim:

1. A signage system, for displaying merchandise, the system comprising a plurality of signs associated with the merchandise, wherein each of the signs comprises a mounting portion, for attachment to a support, and a sign portion, and wherein:

the sign portions comprise at least three different shapes of traffic signs;

the sign portions are angularly offset from the mounting portions;

the sign portions comprise two opposed panels connected together in a parallel and spaced apart orientation;

at least one of the two opposed panels of each of the sign portions includes one or more light emitting devices; and, each of the signs includes circuitry and a power supply for powering the light emitting devices, said circuitry and power supply being contained in the space between the two opposed panels;

wherein each of the signs comprises a single unitary piece including the respective mounting portion and sign portion.

2. The signage system of claim 1, wherein the shapes of the sign portions are chosen from octagons, triangles, diamonds, squares, and rectangles.

3. A signage kit for displaying merchandise, the kit comprising a plurality of signs, wherein each of the signs comprises a mounting portion for attachment to a support, and a sign portion, and wherein:

the sign portions comprise at least three different shapes of traffic signs; and, the sign portions are angularly offset from the mounting portions;

wherein the sign portions comprise two opposed panels connected together in a parallel and spaced apart orientation;

at least one of the two opposed panels of each of the sign portions includes one or more light emitting devices; and, each of the signs includes circuitry and a power supply for powering the light emitting devices, said circuitry and power supply being contained in the space between the two opposed panels;

wherein each of the signs comprises a single unitary piece including the respective mounting portion and sign portion.

4. The signage kit of claim 3, wherein the shapes of the sign portions are chosen from octagons, triangles, diamonds, squares, and rectangles.

5. A method of displaying merchandise on a support, the method comprising:

providing a plurality of signs, wherein each of the signs comprise a mounting portion for attachment to a support and a sign portion and wherein the sign portions comprise at least three different shapes of traffic signs, the sign portions being angularly offset from the mounting portions and comprising two opposed panels connected together in a parallel and spaced apart orientation, wherein each of the signs comprises a single unitary piece including the respective mounting portion and sign portion;

attaching the mounting portions of the signs to one or more supports; and, arranging the signs so as to convey visual information on said merchandise to customers by means of the shapes of traffic signs;

wherein the method further comprises visually signaling the visual information by providing each of the sign portions with one or more light emitting devices, and wherein circuitry and power supplies for the one or more light emitting is contained within the space between the opposed panels.

6. The method of claim 5, wherein the visual information is conveyed by using sign portions having shapes chosen from octagons, triangles, diamonds, squares, or rectangles.

7. A sign for displaying merchandise, the sign being adapted to be mounted to a support, the sign comprising a mounting portion, for attachment to the support, and a sign portion, wherein:

the sign portion comprises the shape of an octagon, a triangle, a diamond, a square, or a rectangle;

the sign portion being angularly offset from the mounting portion;

and wherein the sign portion comprises two opposed panels connected together in a generally parallel and spaced apart orientation;

at least one of the two opposed panels of the sign portion includes one or more light emitting devices; and, the sign includes circuitry and a power supply for powering the light emitting devices, said circuitry and power supply being contained in the space between the two opposed panels;

wherein the sign comprises a single unitary piece including the mounting portion and the sign portion.

* * * * *